US005172499A

United States Patent [19]

Griffin

[11] Patent Number: 5,172,499

[45] Date of Patent: Dec. 22, 1992

[54] COMBINATION SCRAPER/LOADER

[75] Inventor: John Griffin, Monroe, N.C.

[73] Assignee: Gill Industries, L.P., Charlotte, N.C.

[21] Appl. No.: 720,606

[22] Filed: Jun. 25, 1991

[51] Int. Cl.[5] ..... E02F 3/76

[52] U.S. Cl. ..... 37/117.5; 172/445.1; 172/245; 172/684.5; 37/DIG. 12

[58] Field of Search ..... 172/445.1, 810, 784, 172/243, 245, 250, 254, 253, 684.5; 37/117.5, 137, 138, 139, DIG. 3, DIG. 12, DIG. 13

[56] References Cited

U.S. PATENT DOCUMENTS

| | | | |
|---|---|---|---|
| 2,433,019 | 12/1947 | Arps | 172/445.1 |
| 2,774,155 | 12/1956 | Hipp | 172/253 |
| 3,912,092 | 10/1975 | Bolton et al. | 172/445.1 |
| 4,103,796 | 8/1978 | Hare | 172/445.1 |
| 4,333,250 | 6/1982 | Henderson | 172/445.1 |
| 4,337,833 | 7/1982 | Welch | 172/445.1 |
| 4,524,532 | 6/1985 | Browning | 172/445.1 |
| 4,869,326 | 9/1989 | Hutchins et al. | 172/445.1 |
| 4,890,400 | 1/1990 | Long | 37/DIG. 12 |

FOREIGN PATENT DOCUMENTS

| | | | |
|---|---|---|---|
| 1399883 | 7/1975 | United Kingdom | 37/117.5 |

OTHER PUBLICATIONS

"Construction Attachments LTD", Ford Tractor, 2 pages.

"Gill Box Scraper" Brochure, 4 pages.

"The Total Landscape Machine", Gill, 2 pages.

"Bale Carrier", Flyer.

"Kness Scoop-N-Haul", Farm Equipment & Showcase'91, p. 42.

"Kubota Box Scrapers" Flyer, Kubota Tractor Corp., 1-.

*Primary Examiner*—Randolph A. Reese

*Assistant Examiner*—Spencer Warnick

*Attorney, Agent, or Firm*—Shefte, Pinckney & Sawyer

[57] ABSTRACT

A conmbination scraper/loader for mounting on the three-point hitch of a tractor which includes a back wall having a forwardly facing scraper blade and a rearwardly facing scraper blade at its lower edge, and two side walls extending from the back wall in spaced parallel relation. A bottom wall is pivotally mounted to the side walls and is operable between a first position at which it closes the bottom face of the scraper/loader, and a second pivoted position at which it opens such bottom face to permit collected dirt to be dumped therefrom. The scraper/loader 10 has a forward set and a rearward set of pivot pins for connection to the tractor in two separate dispositions, and an operating lever for releasing the pivoted bottom wall is provided which can be reached by the operator of the tractor in either disposition of the scraper/loader 10 on the tractor. The pivoted bottom wall may also be entirely removed from the scraper/loader so that it can be used as a conventional box scraper.

20 Claims, 8 Drawing Sheets

COMBINATION SCRAPER/LOADER

BACKGROUND OF THE INVENTION

Landscaping equipment used in the construction industry comes in a wide variety of forms, and two of the most common types of such equipment are scrapers and loaders.

In general, scrapers are provided in two basic configurations, the first being a unit that is provided with a specially formed scraper blade having a straight bottom edge that is designed to scrape and level the ground over which it is moved, usually by a tractor or other vehicle having the scraper blade mounted on the front end thereof. The scraper blade in this configuration is usually mounted on the tractor or other vehicle at a slanted disposition with respect to the forward direction of movement thereof so that the dirt that is separated from the ground by the scraper blade is moved along the width thereof past the edge of the scraper blade where it is deposited for subsequent collection, usually by another piece of equipment, such as a front end loader.

In another configuration, usually referred to as a box scraper, the scraper blade is fixed to two side walls that extend forwardly in parallel relation from the scraper blade so that as the dirt is separated by the forward edge of the scraper blade, it will be pushed along in front of the scraper blade and will accumulate within the confines of the three walls. At periodic intervals, the box scraper is raised and passed over the mound of accumulated dirt so that the accumulated dirt remains where it is, or is subsequently collected and removed, such as by a front end loader, and the box scraper is then moved and lowered to the ground to commence again its scraping function.

On the other hand, loaders generally include a bucket or scoop that has a bottom wall and side walls defining a relatively large contained volume, and the loader is mounted on a vehicle so that it can be manipulated to position it sideways so that its open top portion can be moved into a mound or pile of dirt and cause the dirt to flow into the bucket until it is substantially filled, after which the bucket is turned on its axis so that the open top portion faces upwardly and the dirt is fully contained by the side walls and bottom, whereby it can be raised and transported to any desired location where the bucket is again manipulated to turn the bucket about its axis and dump the dirt therefrom.

Heretofore, scrapers and loaders of the above-described types were made as separate and distinct units which had to be utilized individually in addressing different tasks. In accordance with the present invention, a simple unit is provided which can be used as both a scraper and a loader with only a minor and easily accomplished adjustment of the unit.

Finally, so-called "four-in-one" buckets are known which are mounted on front end loaders and the like, and they include a pair of pivoted jaws, one of which is provided with teeth and both of which are formed with a scraper blade. By manipulating the two pivoted jaws, usually by using hydraulic cylinders, this bucket can be used for a multiplicity of functions, including scraping, loading, grabbing and dozing. While these buckets are versatile, they can only be used on loaders and they require hydraulic systems for moving the jaws, all of which adds to the complexity and expense of the bucket.

SUMMARY OF THE INVENTION

In accordance with the present invention, a unique combination scraper/loader is provided for attachment to the three-point hitch of a tractor, and the apparatus includes a box member having a back wall with a scraper blade formed at the bottom edge of one face thereof, and a pair of side walls extending away from such one face of the back wall in spaced parallel relation. A bottom wall normally extends between the side walls along the bottom edges thereof, and the bottom wall has a front edge that is formed for scraping and collecting dirt, the bottom wall being connected to the box member by an arrangement which permits selective movement of the bottom wall between a closed position at which it extends between the side walls to form a bottom for the box member, and an open position at which it opens the area between the side walls to release any dirt contained in the box member. Preferably, this connecting arrangement also includes a quick disconnect arrangement by which the bottom wall can be easily and quickly detached from the box member, whereby the box member is capable of operating as a box scraper. An operating device is provided to be selectively operable between a first position for holding the bottom wall at its aforesaid closed position, and a second position at which it permits the bottom wall to assume its open position, and a mounting arrangement is provided for mounting the box member to the aforesaid three-point hitch of the tractor.

In the preferred embodiment of the present invention, the mounting arrangement for the box member includes a pair of spaced pivot rods which are located in a common vertical plane that is parallel to the back wall of the box member, and a third pivot point which is located above the pair of pivot rods and spaced from the common plane thereof in a direction away from the back wall. By virtue of this arrangement, when the three pivot points are connected to a conventional three-point hitch of a tractor, the raising of the three-point hitch will result in the box member shifting from a first lowered position at which the front edge of the bottom wall is engaging the ground and such bottom wall extends at a slight slant upwardly therefrom whereby the box member is positioned for scraping and scooping up dirt as it moves along the ground, and a raised position at which the bottom wall of the box member slants downwardly from the front edge thereof so that dirt will be held and contained in the box member and can be transported to any convenient location by the tractor. The mounting arrangement may also include a second set of three pivot shafts fixed to the box member to permit the box member to be mounted to the three-point hitch of a tractor with the outside face of the box member back wall facing away from the tractor so that it can be pushed along in front of the tractor and function as a conventional scraper blade.

Also, in the preferred embodiment of the present invention, the connecting arrangement for the bottom wall includes two pivot pins projecting outwardly from the two box member side walls, respectively, and the bottom wall is formed with upwardly extending flanges at its side edges, each of the flanges being formed with a slot for slidably receiving the pivot pins therein, and a retaining pin is removably mounted in each of the slots to normally maintain the pivot pins in the slots for pivotal movement of the bottom wall. However, when the retaining pins are removed, the bottom wall can be easily detached from the box member by sliding it along the pivot pins until they clear the slots. Finally, the arrangement for operating the bottom wall between its opened and closed positions preferably includes a pivoted handle member having a hook portion at the bottom thereof for selectively engaging the bottom wall in one pivoted position of the handle, and releasing the bottom wall in the other pivoted position of the handle. The handle is also formed so that it can be readily grasped by the operator of the tractor without leaving the seat of the tractor.

DESCRIPTION OF THE PREFERRED EMBODIMENT

Figure 1:
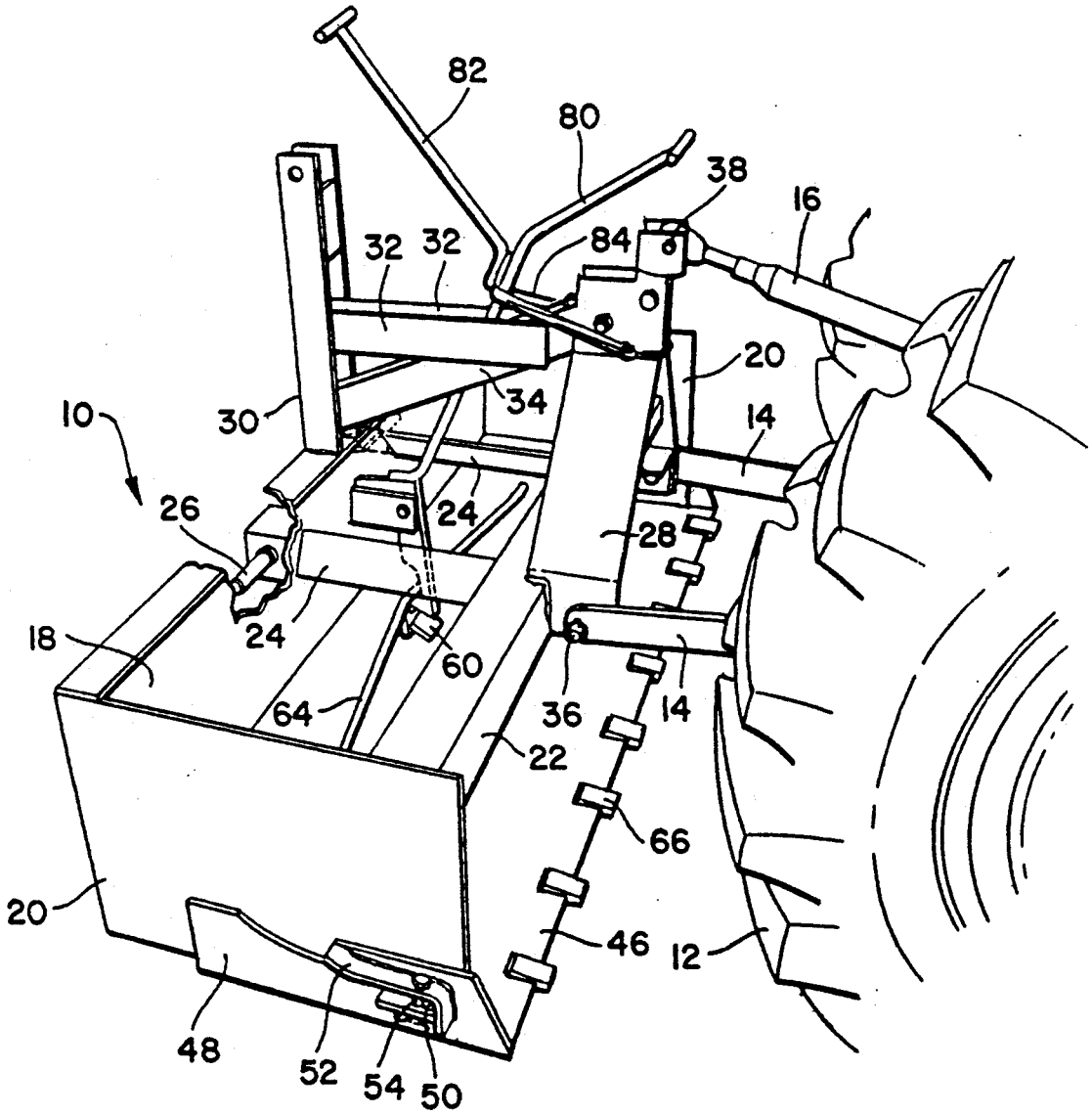
FIG. 1 is a perspective view of the scraper/loader of the present invention, shown attached to a conventional three-point hitch of a tractor.
Figure 2:
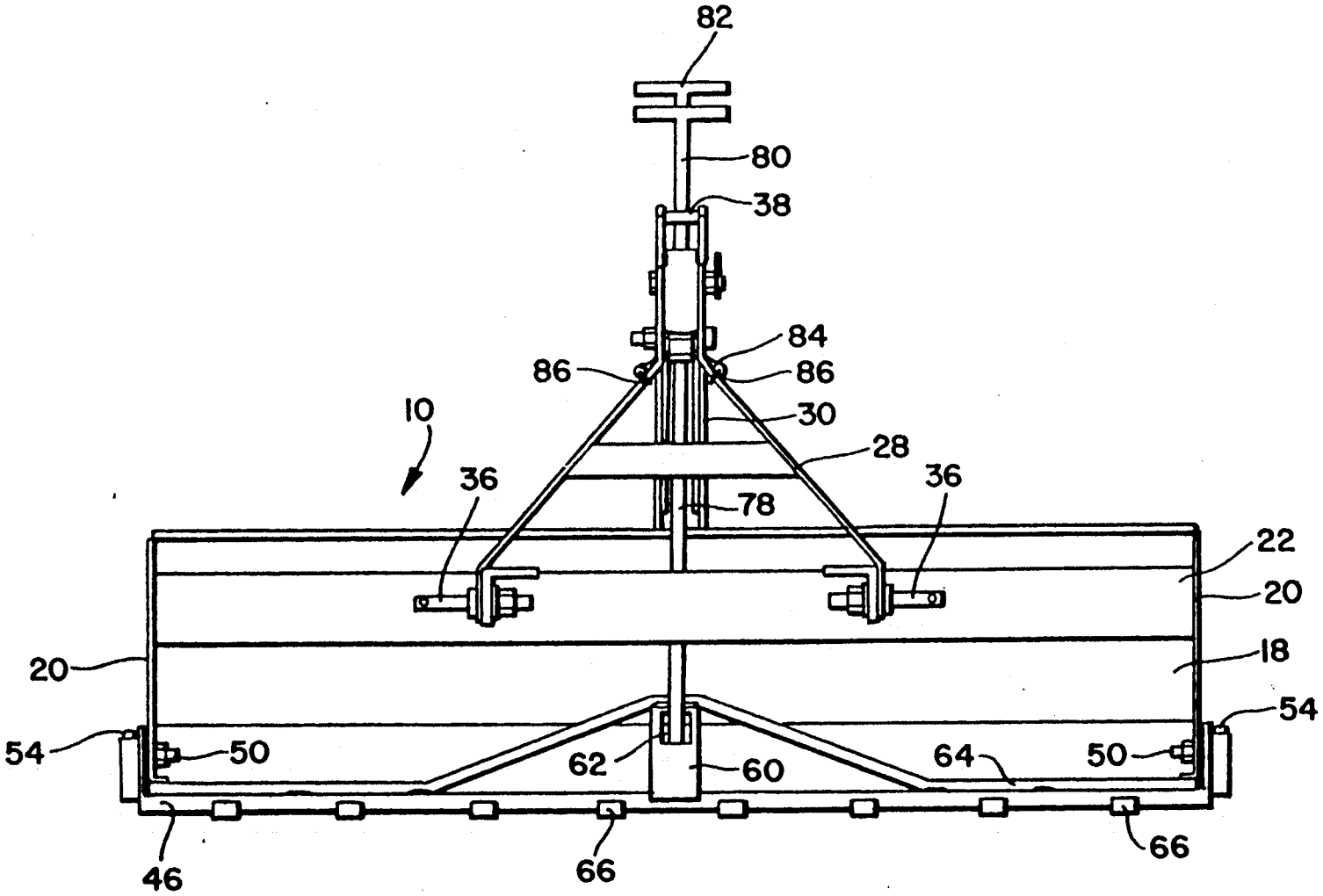
FIG. 2 is a front elevational view of the scraper/-loader shown in FIG. 1.

Looking now in greater detail at the accompanying drawings, FIG. 1 illustrates, in a generally perspective view, the scraper/loader 10 of the present invention attached to a conventional three-point hitch extending from the rear of a tractor 12, the three-point hitch consisting of two lower arms 14 extending in generally parallel relation to one another, and a upper actuating arm 16.

Figure 4:
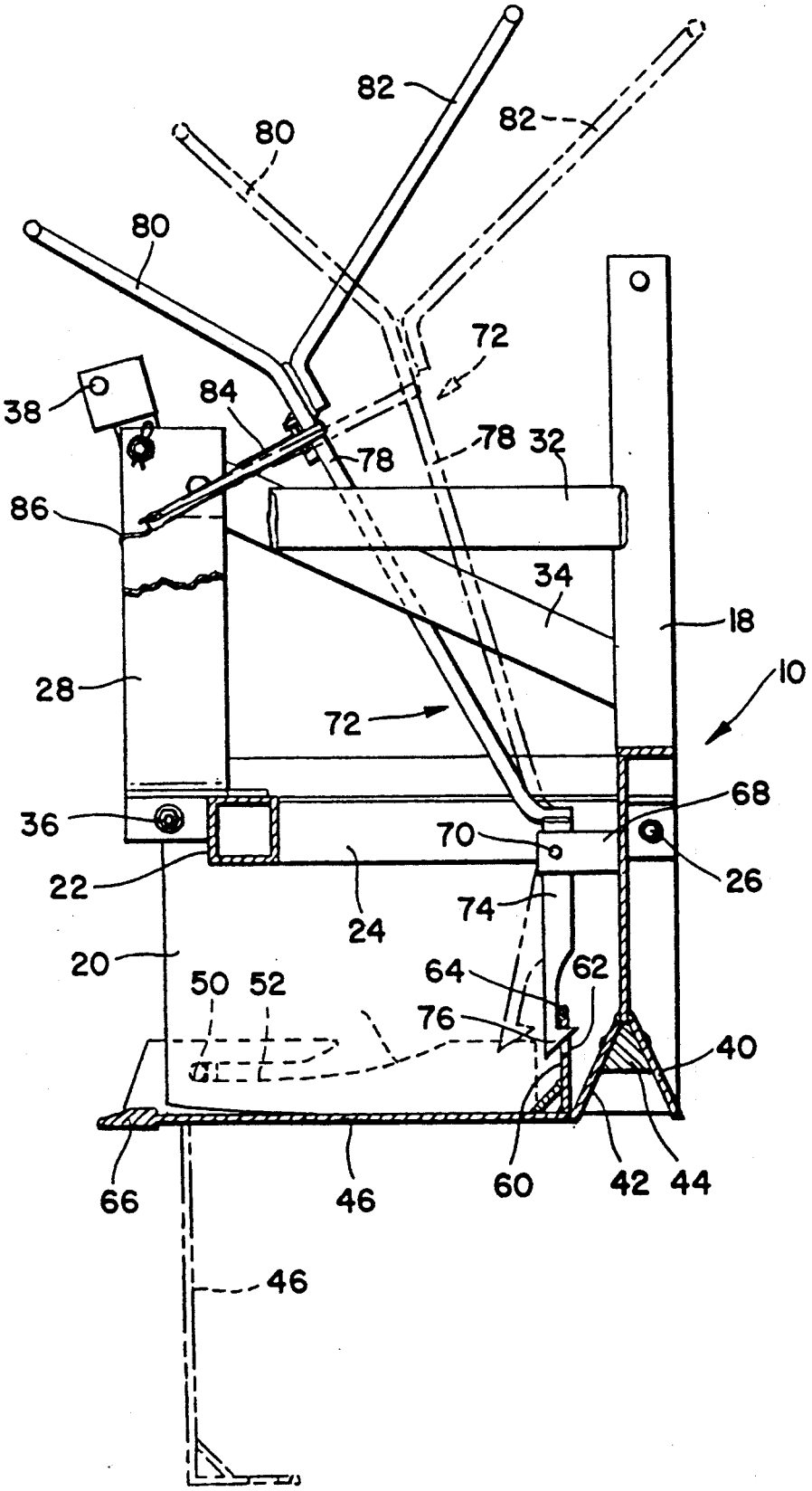
FIG. 4 is a schematic view illustrating the operation of the handle for selectively engaging and releasing the bottom wall of the box member.

The scraper/loader 10 includes a box member formed by a vertically extending back wall 18 and two vertically extending side walls 20 which extend away from the inside face of the back wall 18 in spaced, parallel relation thereto. A reinforcing beam 22 extends laterally between the two side walls 20, and a pair of reinforcing plates 24 extend between the beam 22 and the back wall 18. A continuation of each of the reinforcing plates 24 supports, respectively, a pivot pin 36 which extends outwardly therefrom. A superstructure is also provided which consists of an inverted V-shaped support member 28 that extends upwardly from the lateral beam 22, a stanchion member 30 that extends upwardly from the back wall 18, and cross pieces 32 and 34 which extend between the stanchion 30 and the support 28. The inverted V-shaped support 28 has a pivot pin 36 extending from each of its lower ends, and a pivot rod 38 extends between a pair of flanges 39 which are pivotally mounted on the support member 28 at the upper end of the support 28, it being noted, as best seen in FIG. 4, that the lower pivot pins 36 are in a common vertical plane that is generally parallel to the plane of the back wall 18, and the upper pivot shaft 38 is spaced from the plane in a direction away from the back wall, all for a purpose to be explained in greater detail presently. As best seen in FIG. 4, which is a vertical section view taken through the approximate center of the scraper/-loader 10, the lower edge of the back wall 18 is formed with a first scraper blade portion 40 extending in an angular relationship away from the outside face of the back wall 18, and a second scraper blade 42 which extends in an opposite angular direction from the inside face of the back wall 18, a reinforcing structural element 44 being disposed between the scraper blades 40, 42.

Figure 3:
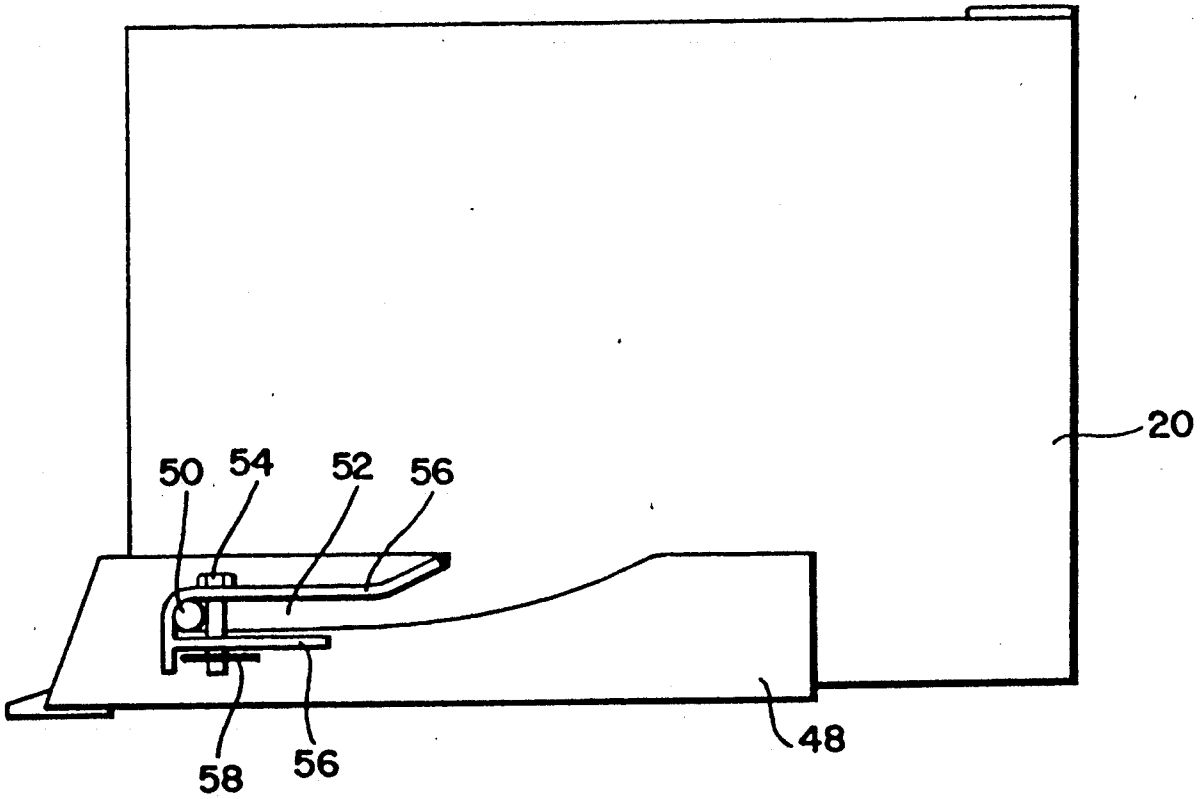
FIG. 3 is a detail view showing the connection between the bottom wall and the side walls of the box member.

As best seen in FIGS. 3 and 4, a bottom wall 46 is positioned at the bottom edges of the back wall 18 and the two side walls 20, and the bottom wall 46 includes two vertical upstanding flanges 48 at each of its side edges which are disposed outwardly of the side wall 20 and closely adjacent thereto. The bottom wall 46 is mounted to the side walls 20 by a pair of pivot shafts 50 which extend outwardly from the two side walls 20, respectively, into a horizontally extending slot 52 which is formed in each of the side flanges 48, and a retaining pin 54 extends through spaced horizontal flanges 56 which extend outwardly from the side flanges 48, the retaining pins 54 being located closely adjacent the pivot shafts 50 and having a cotter pin 58 which extends through the lower portion of the retaining pins 54 to normally maintain it in place as shown in FIG. 3, but also permitting the retaining pins 54 to be removed from the flanges 56 when the cotter pin 58 is removed. The rear edge of the bottom wall 46 abuts the forwardly extending scraper blade 42 (see FIG. 4), and at the approximate center of the back edge an upstanding bracket 60 is provided with a slot 62 formed therein, and a reinforcing rod 64 extends laterally along the bottom wall 46 and across the top of the bracket 60. The front edge of the bottom wall 46 is provided with a plurality of enlarged teeth elements 66 which are disposed at spaced intervals therealong.

As best seen in FIGS. 1 and 4, a support bracket 68 extends outwardly from the inside face of the back wall 18 to support a pivot shaft 70 on which is pivotally mounted a lever 72 that is formed with a flat bottom portion 74 having a hook 76 that can be inserted in, and removed from, the slot 62 in the bracket 60 (see FIG. 4), and an upper portion 78 that is bifurcated to present a first handle portion 80 that extends in a direction towards the front end of the scraper/loader 10 and a second handle 82 that extends in the opposite direction toward the rear end of the scraper/loader 10. A resilient strip 84, preferably formed of rubber or the like, is anchored at each of its ends by a hook bracket 86 which engages the resilient strip 84 and the V-shaped support 28 so that the resilient element passes around the upper portion 78 of the lever 72 and urges it in a direction toward the V-shaped support 28, whereby the lever 72 is normally maintained in the position shown in full lines in FIG. 4 with the hook 76 inserted in the slot 62 to hold the bottom wall 46 in its raised position at the bottom edges of the side walls 20 and the back wall 18. However, the upper portion 78 of the lever 72 may be moved in a direction away from the V-shaped support 28, in which case the bottom portion 74 of the lever 72 is pivoted about the pivot shaft 70 to move the hook 76 out of the slot 62 as shown in the dotted lines in FIG. 4, whereupon the bottom wall 46 is released and it will pivot downwardly about the pivot shafts 50 and hang vertically therefrom as illustrated in FIG. 4.

The unique features of the scraper/loader 10 described above make it extremely versatile and capable of carrying out a multiplicity of functions which heretofore required separate devices or implements specially designed for a specific function, this versatility being illustrated diagrammatically in FIGS. 5–12.

Figure 6:
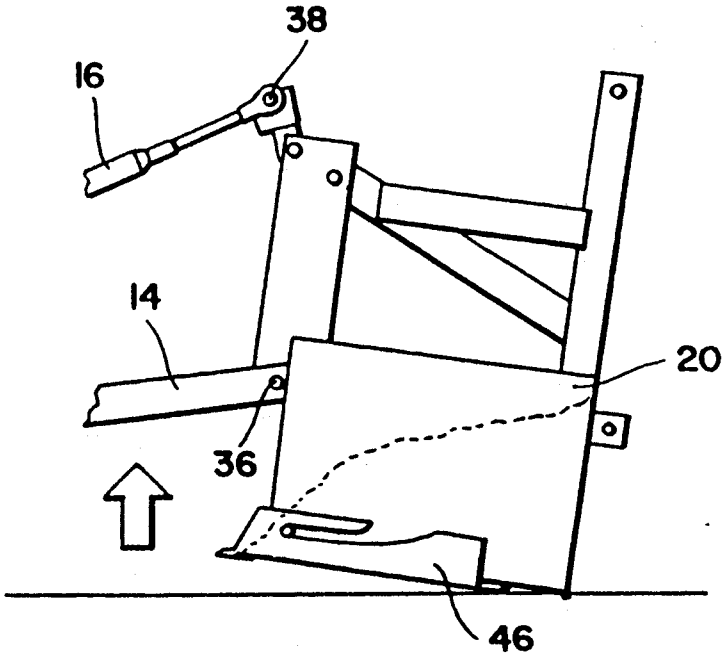
FIGS. 5-12 are a series of diagrammatic views illustrating the various applications of the scraper/loader of the present invention.
Figure 5:
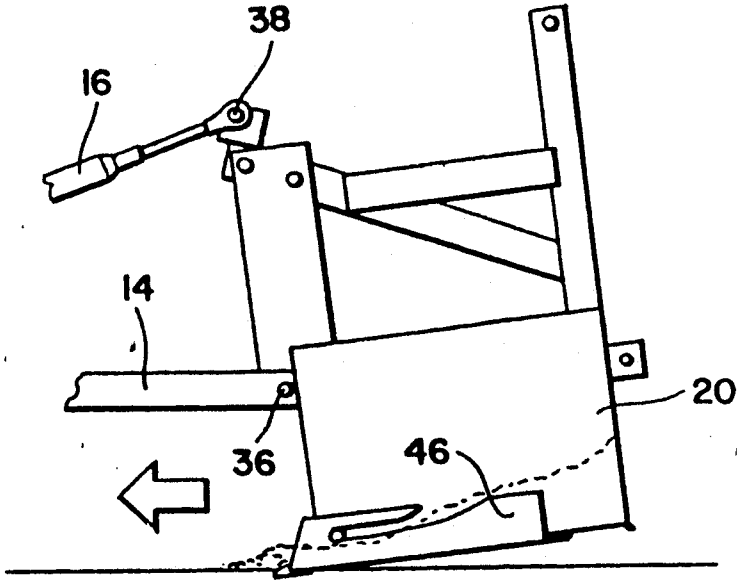
Figure 7:
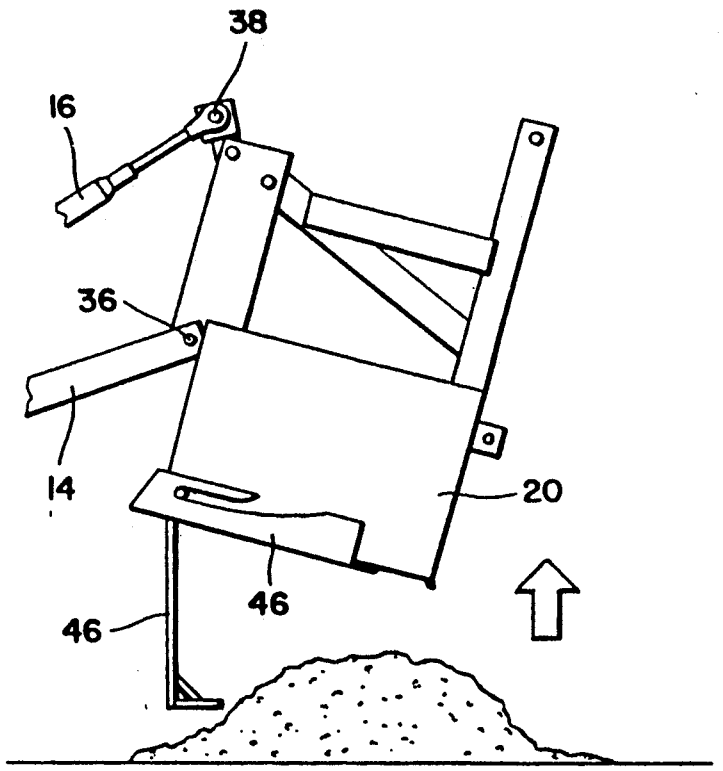

In FIGS. 5 and 6, the scraper/loader 10 is shown mounted on the three-point hitch of a tractor with the open front end of the scraper/loader facing in the direction of movement of the tractor, which is indicated by the direction arrow in FIG. 5. The bottom wall 46 is in place, and in this configuration the scraper/loader 10 is pulled behind the tractor and acts as a scoop to collect dirt which is scraped up by the front edge of the bottom wall 46 and moved into the confines of the scraper/loader 10 where it collects. It will be noted that the geometric position of the two front lower pivot pins 36 and the upper pivot shaft 38 is such that when they are connected to the three-point hitch the scraper/loader 10 is slanted slightly upwardly from the front edge of the bottom wall 46, the angle of this tilting being somewhat exaggerated in the drawings for clarity of illustration. Accordingly, the scraper/loader 10 performs effectively as a scoop for scraping up, digging, or collecting dirt or other material. After the scraper/loader 10 has collected a predetermined quantity of dirt or other material within its confines, the operator of the tractor raises the three-point hitch as indicated by the direction arrow in FIG. 6 in the conventional manner, whereupon the scraper/loader 10 is initially moved upwardly and the geometry of the aforesaid three pivot shafts, combined with the pivoted flanges 39, is such that the scraper/loader tilts in a direction that the bottom wall 46 extends downwardly from its front edge as illustrated in FIG. 6, this slanted configuration serving to prevent the collected dirt from falling out of the front open end of the scraper/loader 10. Further upward movement of the three-point hitch raises the scraper/loader 10 completely off of the ground as illustrated in FIG. 7, and the scraper/loader 10 can then be transported to any desired dumping location by the tractor 10, at which point the operator of the tractor, without leaving the seat of the tractor, can grasp the forwardly extending handle portion 80 (see FIG. 4) to pivot the operating lever 72 in a direction that will cause the hook 76 to release the bracket 60, whereupon the bottom wall 46 will pivot downwardly to its open position as shown in full lines in FIG. 7 and in dotted lines in FIG. 4 so that all of the dirt collected in the scraper/loader 10 is dumped therefrom. It will be noted that the pivot shafts 50 are located near the front open end of the scraper/loader 10, so that when the bottom wall 46 pivots downwardly as shown in FIG. 7, the dirt falls in a direction away directly beneath the scraper/loader 10 rather than falling into or onto the tractor.

After the dirt has been dumped, the operating lever 72 will have been moved back to its holding position by the bias of the resilient member 84, and the operator of the tractor can then simply lower the three-point hitch to lower the scraper/loader 10, and this lowering motion will cause the bottom wall 46 to be pushed up to its original position adjacent the side walls 20 and the back wall 18, and, as best seen in FIG. 4, this upward pivotal movement of the bottom wall 46 will result in the upper surface of the bracket 60 sliding along the slanted cam surface at the bottom of the hook 76 until the hook is urged back into the slot 62 by the resilient strip 84, and the scraper/loader is then ready to commence further scooping and loading functions.

Figure 8:
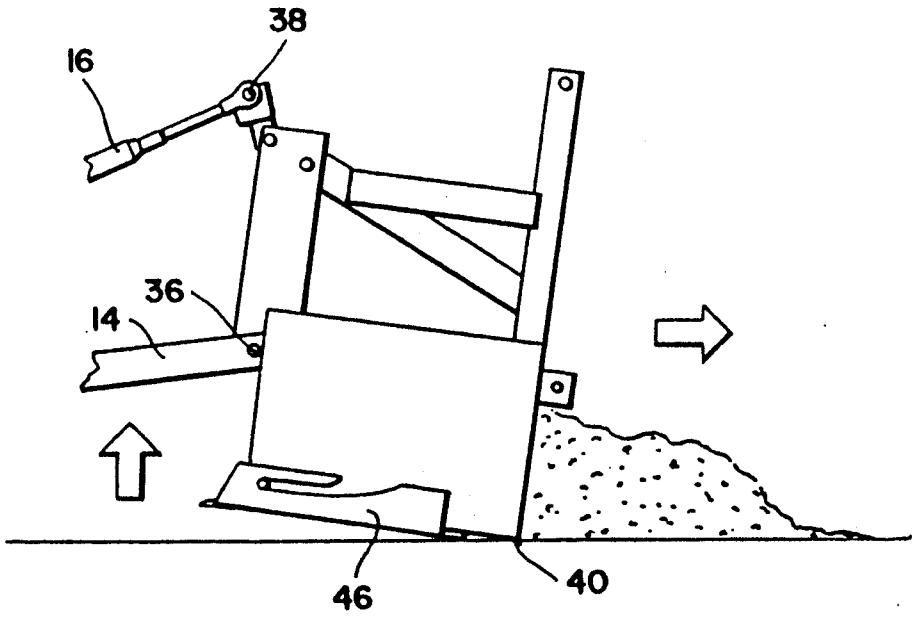

As shown in FIG. 8, the scraper/loader 10 can, without any change in its structure or its mounting to the tractor, operate as a conventional scraper if the tractor 10 is moved in a backward direction so that the scraper/loader 10 is pushed along in front of the rearwardly moving tractor. As shown in FIG. 8, in this configuration the scraper blade 40 at the back face of the back wall 46 engages the ground and scrapes the ground in the same manner as a conventional scraper. Again, it is to be noted that the angle of tilt of the scraper/loader 10 is exaggerated in FIG. 8 for clarity of illustration, and, in this regard, it is significant to note that the pivoted flanges 39, in which the upper pivot shaft 38 is located, reacts to the forces being imposed on the scraper/loader 10 and permits the slight angular movement of the scraper/loader 10 so that it can have a slight downward slant toward the front edge of the bottom wall 46 when the scraper/loader 10 is being pulled along behind a forwardly moving tractor as shown in FIG. 5, and can also have a slight upward slant from the front edge of the bottom wall 46 when it is being pushed ahead of a rearwardly moving tractor as shown in FIG. 8. The pivoted flanges 39 also permit the scraper/loader 10 to have a slight downward slant from the front edge of the bottom wall 41 when it is raised, as shown in FIG. 7.

Figure 9:
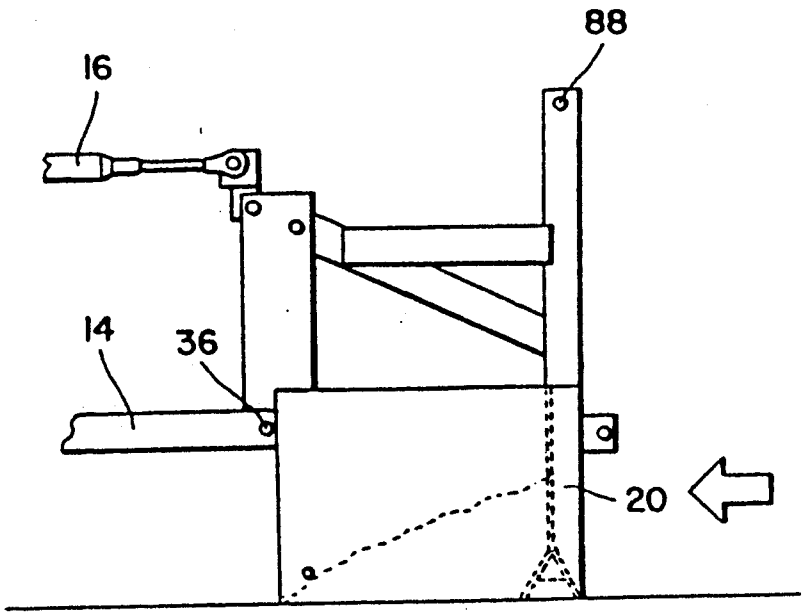

When it is desired to use the scraper/loader 10 in the same manner as a conventional box scraper, the bottom wall 46 is removed altogether by simply removing the cotter pins 58 and the retaining pins 54 (see FIG. 3), after which the bottom wall can be manually moved forwardly so that the pivot pin 50 slides along the slot 52 until it clears the slot and the bottom wall 46 is entirely separated from the scraper/loader. In this configuration, as illustrated in FIG. 9, the scraper/loader 10 is attached to the three-point hitch in the same manner as in FIGS. 5–7 described above, but when the scraper/loader 10 is lowered to a position engaging the ground and pulled forward by the tractor, the ground will be engaged by the front scraper blade 42 at the bottom of the back wall 18 to scrape dirt and cause it to be maintained within the confines of the side walls 20 and the back wall 18 in the manner of a conventional box scraper as described above.

Figure 10:
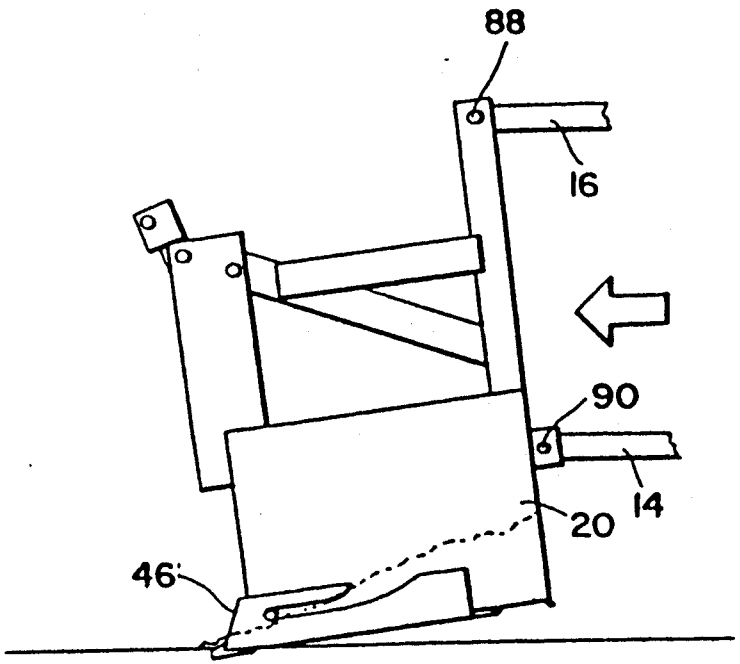
Figure 11:
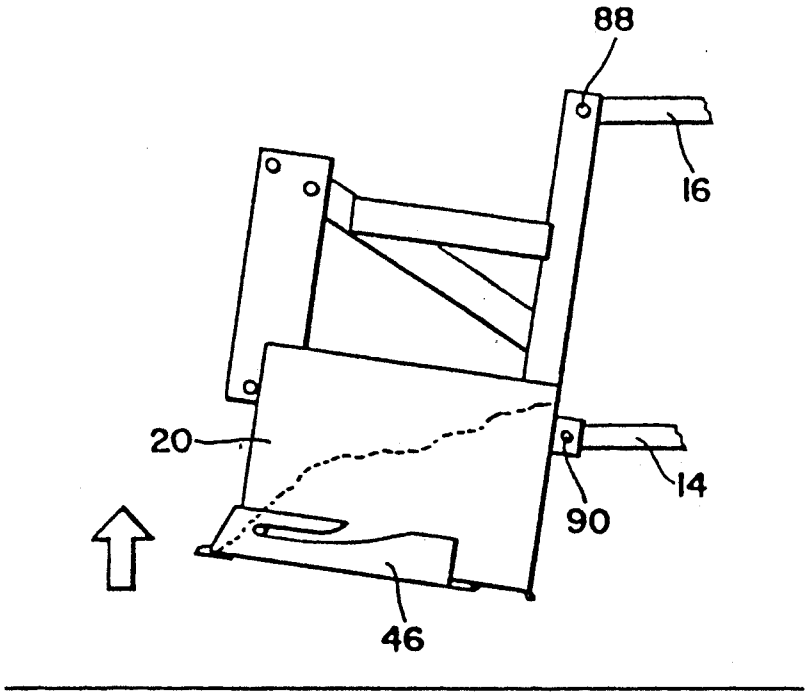

In FIGS. 10 and 11, the scraper/loader 10 is mounted to the conventional three-point hitch of the tractor at the back pivot pins 90 and 88, and the geometric positioning of these pivots relative to the movement of the arms 14 and 16 of the three-point hitch is such that when the scraper/loader 10 engages the ground it will be slanted slightly upwardly from the front edge of the bottom wall 46 so that when the tractor is moved rearwardly, the scraper/loader 10 acts as a scoop in the same manner as that described above in connection with FIG. 5. Similarly, when it is desirable to dump the dirt collected in the scraper/loader 10, the three-point hitch is raised, and above-described geometric positioning of the pivots relative to the three-point hitch causes the tilt of the scraper/loader 10 to change as illustrated in FIG. 11 to hold the dirt therein, and the tractor can then be taken to any convenient dumping point at which the operator of the tractor moves the operating lever 72 against its bias to release the bottom wall 46 in the same manner as that described above. It will be noted that when the scraper/loader 10 is mounted to the three-point hitch at its rearward pivot points, the operating lever 72 can still be easily reached by the operator of the tractor without leaving the seat of the tractor because of the forwardly extending bifurcated handle portion 82 which will be extending toward the tractor and its operator. Although the utilization of the scraper/loader 10 as a scoop is obviously similar in the configuration shown in FIGS. 5-7 and in FIGS. 10 and 11, there are many situations in which it is desirable to scoop or dig up dirt or other material that is piled or collected at a location (e.g. immediately adjacent a wall) where it would be impossible to position the scraper/loader 10 if its open front end is immediately behind the tractor as shown in FIG. 5, and in these circumstances the scraper/loader 10 can be easily mounted on the tractor with the open front end thereof facing away from the tractor as shown in FIG. 10 so that the scraper/loader 10 can be used to collect the otherwise inaccessible dirt by backing the tractor.

Figure 12:
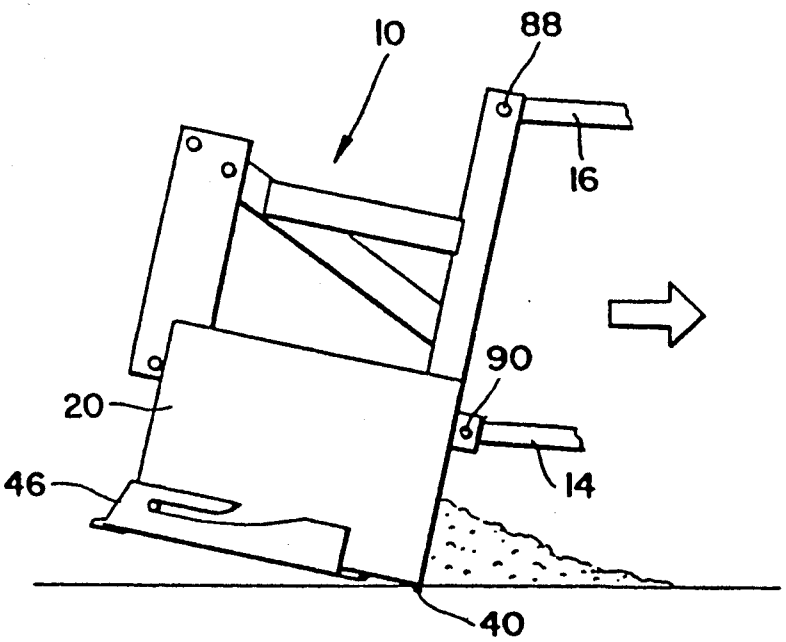

Also, as illustrated in FIG. 12, when the scraper/-loader 10 is mounted at its rearward three pivot shafts, it can be used as a conventional scraper by pulling it along behind a forwardly moving tractor with the scraper blade 40 scraping the ground in essentially the same manner as that described above in connection with FIG. 8.

It will be apparent from the above that the scraper/-loader 10 of the present invention can be used for a variety of different utility, landscaping or agricultural operations which, in the past, have required the use of several different implements. Moreover, when it is desired to remove the bottom wall 46 so that the scraper/-loader 10 can be used as a box scraper, the entire removal process is quite easy and can be accomplished quite quickly. Also, the versatility of the scraper/loader 10 is further enhanced by the fact that the pivoted bottom wall 46 can be released to its open position by the operator of the tractor, regardless of whether the scraper/loader 10 is mounted on the three-point hitch at the three rearward pivot shafts or the three forward pivot shafts, and the open bottom wall 46 will automatically resume its position held in place at the bottom edges of the side walls 20 and the back wall 18 by simply lowering the scraper/loader 10 so that the bottom wall 46 is pushed upwardly into this position by engagement with the ground.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for attachment to a vehicle having a three-point hitch and used to scoop, dig, scarify, scrape and/or load dirt, such apparatus comprising:

(a) a box member having two spaced parallel side walls open at one end thereof and a back wall extending between said side walls at the other end thereof to form a generally rectangular container for dirt;

(b) a generally flat bottom wall extending between said side walls and having a bound edge thereof located at said one open end of said side wall, said edge being formed for scooping or digging dirt;

(c) pivot means connecting said bottom wall to said box member to permit selective movement of said bottom wall between a closed position at which it extends between said side walls to form a bottom of said box member and at which said formed edge is adjacent said one open end of said box member and an open position at which it opens the area between said side walls to release dirt contained in said box member, said pivot means including means for detaching said bottom wall from said box member at the point where said bottom wall is connected to said box member;

(d) operating means operable between a first position holding said bottom wall at said closed position thereof with respect to said side walls and a second position to release said bottom wall and permit it to assume said open position thereof; and (e) first mounting means adapted for mounting said box member to said three-point hitch of said vehicle to permit movement of said box member between a lower position at which said bottom wall edge engages the ground and said bottom wall is slanted upwardly therefrom, and a raised position at which said bottom wall is above the ground and slanted downwardly from said edge so as to retain dirt in said box member until said operating means is operated to said second position thereof.

2. Apparatus as defined in claim 1, wherein said back wall of said box member includes a first scraper blade fixed at the bottom edge of one face thereof and a second scraper blade fixed at the bottom edge of the other face thereof, whereby said back wall can act as a scraper when said vehicle is traveling in one direction and can be used as a box scraper when said vehicle is traveling in the opposite direction and said bottom wall is detached from said box member.

3. Apparatus as defined in claim 1, wherein said bottom wall includes two flanges extending upwardly a each side edge thereof.

4. Apparatus as defined in claim 3, wherein said pivot means includes a pivot rod extending outwardly from each said side wall of said box member, a pair of slots formed to extend laterally in said flanges, and selectively removable retaining pins for normally maintaining said pivot rods in said slots whereby said bottom wall is pivotal about said pivot rods, and for permitting said pivot rods to be removed from said slots to detach said bottom wall.

5. Apparatus as defined in claim 1, wherein said operating means includes a hook portion for selectively engaging and disengaging said bottom wall, and a handle portion for moving said hook portion between an engaging position at which it engages said bottom wall and holds it at said closed position thereof and a release position at which it releases said bottom wall to permit it to pivot to said open position thereof.

6. Apparatus as defined in claim 5, wherein said handle portion of said operating means extends upwardly above the top of said box member and in a direction toward said mounting means whereby said handle portion ca be grasped and operated by the driver of said vehicle.

7. Apparatus as defined in claim 2, wherein said apparatus includes second mounting means for mounting said box member to said vehicle so that said box member can be positioned with said first scraper blade engaging said ground and with said box member being slanted upwardly from said first scraper blade.

8. Apparatus as defined in claim 7, wherein said operating means includes a handle that has a first portion extending toward said open end of said box member and a second portion extending toward said other end of said box member whereby said handle can be reached by the operator of said vehicle when said box member is mounted to said vehicle by either said first mounting means or said second mounting means.

9. Apparatus as defined in claim 1, wherein the bottom edge of the inside face of said back wall is formed as a scraper blade, whereby said box member operates as a box scraper when said bottom wall is detached.

10. Apparatus as defined in claim 1, wherein said mounting means include a pair of spaced pivot rods mounted on said box member and located in a plane that extends vertically in spaced parallel relation to said back wall, said spaced pivot rods being adapted to be connected to the lowermost two points of said three-point hitch, and a third pivot rod located above said pair of spaced pivot rods and spaced from the plane thereof in a direction away from said back wall, said third pivot rod being adapted to be connected to the uppermost point of said three-point hitch.

11. Apparatus for attachment to a vehicle having a three-point hitch and used to scrape, dig, scarify, scoop and/or load dirt, said apparatus comprising (a) a box member having a back wall with a scraper blade formed at the bottom edge of one face thereof, and a pair of side walls extending away from said one face of said back wall in spaced parallel relation to form a generally rectangular container for dirt;

(b) a generally flat bottom wall normally extending between said side walls along the bottom edges thereof, and having a front edge thereof formed as a scraper blade for scraping dirt;

(c) connecting means for connecting said bottom wall to said box member for selective movement between a closed position at which it extends between said side walls to form a bottom for said box member and at which said front edge is disposed away from said back wall and an open position at which it opens the area between said side walls to release any dirt contained in said box member, said connecting means including quick disconnect means for detaching said bottom wall from said box member whereby said box member is capable of operating as a box scraper;

(d) operating means selectively operable between a first position for holding said bottom wall at said closed position thereof and a second position for permitting said bottom wall to assume said open position thereof; and (e) mounting means adapted for mounting said box member to said three-point hitch of said vehicle.

12. Apparatus as defined in claim 11 wherein the other face of said box member back wall is also formed at its bottom edge as a second scraper blade.

13. Apparatus as defined in claim 12 wherein said mounting means permits movement of said box member between a lower position at which said bottom wall front edge engages the ground and said bottom wall is slanted upwardly therefrom, and a raised position at which said bottom wall is above the ground and slanted downward from said front edge thereof so as to retain dirt in said box member until said operating means is operated to said second position thereof.

14. Apparatus as defined in claim 13, wherein said bottom wall includes two flanges extending upwardly at each side edge thereof.

15. Apparatus as defined in claim 14, wherein said connecting means includes a pivot rod extending outwardly from each said side wall of said box member, a pair of slots formed to extend laterally in said flanges, and selectively removable retaining pins for normally maintaining said pivot rods in said slots whereby said bottom wall is pivotal about said pivot rods, and for permitting said pivot rods to be removed from said slots to detach said bottom wall.

16. Apparatus as defined in claim 11, wherein said operating means includes a hook portion for selectively engaging and disengaging said bottom wall, and a handle portion for moving said hook portion between an engaging position at which it engages said bottom wall and holds it at said closed position thereof and a release position at which it releases said bottom wall to permit the pivot to said open portion thereof.

17. Apparatus as defined in claim 16, wherein said handle portion of said operating means extends upwardly above the top of said box member and in a direction toward said mounting means whereby said handle portion can be grasped and operated by the driver of said vehicle.

18. Apparatus as defined in claim 12, wherein said apparatus includes second mounting means for mounting said box member to said vehicle so that said box member can be positioned with said second scraper blade engaging said ground and with said box member being slanted upwardly from said first scraper blade.

19. Apparatus as defined in claim 13, wherein said mounting means include a pair of spaced pivot rods mounted on said box member and located in a plane that extends vertically in spaced parallel relation to said back wall, said spaced pivot rods being adapted to be connected to the lowermost two points of said three-point hitch, and a third pivot rod located above said pair of spaced pivot rods and spaced from the plane thereof in a direction away from said back wall, said third pivot rod being adapted to be connected to the uppermost point of said three-point hitch.

20. Apparatus for attachment to a vehicle having a three-point hitch and used to scoop, dig, scarify, scrape and/or load dirt, such apparatus comprising:

(a) a box member having two spaced parallel side walls open at one end thereof and a back wall extending between said side walls at the other end thereof to form a generally rectangular container for dirt;

(b) a generally flat bottom wall extending between said side walls and having a formed edge thereof located at said one open end of said side wall, said edge being formed for scooping or digging dirt;

(c) pivot means connecting said bottom wall to said box member to permit selective movement of said bottom wall between a closed position at which it extends between said side walls to form a bottom of said box member and at which said formed edge is adjacent said one open end of said box member and an open position at which it opens the area between said side walls to release dirt contained in said box member;

(d) operating means operable between a first position holding said bottom wall at said closed position thereof with respect to said side walls and a second position to release said bottom wall and permit it to assume said open position thereof;

(e) first mounting means positioned at said open end of said box member and adapted for mounting said box member to said three-point hitch of said vehicle to permit movement of said box member between a first lower position at which said bottom wall edge engages the ground and said bottom wall is slanted upwardly therefrom, and a second raised position at which said bottom wall is above the ground and slanted downwardly from said edge so as to retain dirt in said box member until said operating means is operated to said second position thereof; and (f) second mounting means positioned at said other end of said box member and adapted for mounting said box member to said three-point hitch of said vehicle to permit movement of said box member between said first lower position thereof and said second position thereof, whereby said box member can be movably mounted on said vehicle with said open end of said box member facing toward or away from said vehicle.

* * * * *